US008089414B2

(12) United States Patent
Feldstein et al.

(10) Patent No.: US 8,089,414 B2
(45) **Date of Patent: *Jan. 3, 2012**

(54) WALL-MOUNTED ELECTRICAL DEVICE WITH MODULAR ANTENNA BEZEL FRAME

(75) Inventors: George Feldstein, Cresskill, NJ (US); Stan Wisniewski, Pompton Plains, NJ (US); Philip Bellingham, White Plains, NY (US); Krunoslav Draganovic, Nyack, NY (US)

(73) Assignee: Crestron Electronics Inc, Rockleigh, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/037,709

(22) Filed: Mar. 1, 2011

(65) Prior Publication Data

US 2011/0248893 A1 Oct. 13, 2011

Related U.S. Application Data

(63) Continuation of application No. 12/757,407, filed on Apr. 9, 2010, now Pat. No. 7,928,917.

(51) Int. Cl.
*H01Q 1/24* (2006.01)

(52) U.S. Cl. ..... 343/702

(58) Field of Classification Search ..... 343/702, 343/700 MS, 745–748, 907

See application file for complete search history.

(56) References Cited

U.S. PATENT DOCUMENTS

| | | | | |
|---|---|---|---|---|
| 4,478,468 | A | 10/1984 | Schoen et al. | |
| 4,864,588 | A | 9/1989 | Simpson et al. | |
| 5,189,412 | A | 2/1993 | Mehta et al. | |
| 5,239,205 | A | 8/1993 | Hoffman et al. | |
| 5,736,965 | A | 4/1998 | Mosebrook et al. | |
| 5,818,128 | A | 10/1998 | Hoffman et al. | |
| 5,905,442 | A | 5/1999 | Mosebrook et al. | |
| 5,909,087 | A | 6/1999 | Bryde et al. | |
| 5,949,200 | A | 9/1999 | Ference et al. | |
| 5,982,103 | A | 11/1999 | Mosebrook et al. | |
| 6,000,807 | A | 12/1999 | Moreland | |
| 6,120,262 | A | 9/2000 | McDonough et al. | |
| 6,183,101 | B1 | 2/2001 | Chien | |
| 6,339,400 | B1 | 1/2002 | Flint et al. | |
| 6,444,906 | B1 | 9/2002 | Lewis | |
| D465,460 | S | 11/2002 | Mayo et al. | |
| 6,578,980 | B1 | 6/2003 | Chen et al. | |
| 6,660,948 | B2 | 12/2003 | Clegg et al. | |
| 6,969,959 | B2 | 11/2005 | Black et al. | |
| 6,970,097 | B2 | 11/2005 | Welles et al. | |
| 7,080,787 | B2 | 7/2006 | Wulff et al. | |
| 7,106,261 | B2 * | 9/2006 | Nagel et al. | 343/702 |
| 7,190,125 | B2 | 3/2007 | McDonough et al. | |
| 7,274,117 | B1 | 9/2007 | Viola et al. | |

(Continued)

OTHER PUBLICATIONS

European Search Report dated Dec. 1, 2010.

(Continued)

*Primary Examiner* — Huedung Mancuso

(57) ABSTRACT

An electrical device comprises a bezel frame that is configured to fit within a faceplate. The bezel frame includes an antenna element. The electrical device further comprises a radio frequency circuitry component in electrical communication with the antenna element and configured to receive a control signal from the antenna element and a housing, which includes a housing cover. The housing cover is located between the antenna element and the radio frequency circuitry component. The electrical device further comprises one or more connectors configured to place the antenna element and the radio frequency circuitry component in electrical communication. The one or more connectors protrude through the housing cover.

20 Claims, 11 Drawing Sheets

U.S. PATENT DOCUMENTS

| | | | | |
|---|---|---|---|---|
| 7,335,845 | B2 | 2/2008 | Johnson et al. | |
| 7,342,764 | B2 | 3/2008 | Black | |
| 7,358,927 | B2 * | 4/2008 | Luebke et al. | 343/907 |
| 7,361,853 | B2 | 4/2008 | Clegg et al. | |
| 7,362,285 | B2 | 4/2008 | Webb et al. | |
| 7,408,525 | B2 | 8/2008 | Webb et al. | |
| 7,414,210 | B2 | 8/2008 | Clegg et al. | |
| 7,432,460 | B2 | 10/2008 | Clegg et al. | |
| 7,432,463 | B2 | 10/2008 | Clegg et al. | |
| 2002/0024332 | A1 | 2/2002 | Gardner | |
| 2006/0273970 | A1 | 12/2006 | Mosebrook et al. | |
| 2007/0285320 | A1 * | 12/2007 | Hayes et al. | 343/702 |
| 2009/0009391 | A1 * | 1/2009 | Fox et al. | 342/372 |
| 2009/0184652 | A1 | 7/2009 | Bollinger, Jr. et al. | |

OTHER PUBLICATIONS

Case 2:09-cv-00707 Lutron Electronics Co., Inc., v. Crestron Electronics, Inc., a New Jersey corporation, Face Group, Inc. D/B/A Lifestyle Electronics, a Utah corporation, Lava Corp., a Utah corporation, Audio Vision Systems, LLC, a Utah limited liability company. Attached is the complaint in Exhibit A, Feb. 2, 2011.

* cited by examiner

WALL-MOUNTED ELECTRICAL DEVICE WITH MODULAR ANTENNA BEZEL FRAME

BACKGROUND

1. Technical Field

The subject matter described herein relates to wall mounted electrical control devices that can be remotely controlled and monitored via radio frequency transmissions. The subject matter described herein also relates to remote control devices for controlling and monitoring the wall mounted electrical control devices. More particularly, the subject matter described herein relates to electrical devices that can include one or more interchangeable key capsules, one or more associated interchangeable bezel frames which include a radio frequency antenna element, and one or more interchangeable radio frequency circuitry components.

2. Background Art

The field of home automation is rapidly developing. The ability to control electrical fixtures, appliances, and electronics remotely or through a central location is becoming more and more common place. Remote electronic control devices, such as lighting dimmers, include control circuitry and processors which can be powered by internal power supplies that derive power from high voltage house wiring that is typically 120 VAC (volts, alternating current) in the United States.

Wall mounted switching devices such as light switches and dimmers are typically placed inside a junction box or mounting fixture. In commercial construction, metal wallboxes are often used. A metal electrical wallbox along with a metal faceplate can act as a Faraday cage that significantly attenuates the transmission of radio frequency electromagnetic radiation from the antenna. As such, antenna location is an important factor.

Traditional radio Frequency (RF)-Controlled lighting dimmers have typically operated using RF frequencies, such as 418 megahertz (MHz), that have a relatively long ¼ wavelength (i.e. 6¾ inches) with respect to the physical dimensions of a residential single-gang wallbox that conforms to National Electrical Manufacturers Association (NEMA) specifications (i.e., 2¼ inches (W)×3¾ inches (L)×3¼ inches (D)). Those skilled in the art will recognize that the physical dimensions of an antenna, particularly the 'length' dimension, are primary determined by the ¼ wavelength (λ) of the operating frequency of the antenna. Various methods have been employed in the prior art to accommodate undesirable long antennas used to satisfy the ¼ wavelength (λ) standard at operational frequencies such as 418 MHz.

As an example, some traditional devices use a printed circuit board (PCB) antenna that includes capacitors to help balance the inherent inductive load. Prior art FIG. 1 depicts a wall mounted RF-controlled lighting dimmer 20, that incorporates a PCB antenna with dimensions much smaller than a ¼ wavelength (λ) of the intended operating frequency. This allows the antenna (not visible) to fit behind a faceplate 6 that covers the opening of a wall 7 cut to accommodate an electrical wallbox. A perimeter of the faceplate 6 includes left edges 31, right edges 32, top edges 33, and bottom edges 34. Prior art FIG. 2 depicts a wallbox 8 covered by a front surface 9 of a faceplate as part of an RF-controlled lighting control device according to a traditional system. The system includes a printed circuit board (PCB) antenna that fits behind a front surface of the faceplate and within the area defined by the faceplate. Prior art FIG. 3 shows a typical PCB antenna 24 that is used in traditional devices.

Prior art FIG. 4 illustrates an attempt to accommodate an extended wire antenna 242. As illustrated in FIG. 4, the extended wire antenna 242 extends for several inches outside of a wall-mounted electrical device, such as a lighting dimmer 20. As illustrated, the extended wire antenna 242 that extends from the lighting dimmer 20 is wrapped around the lighting dimmer 20 in order to conceal the extended wire antenna behind a faceplate 6 (indicated by the dashed lines). Such a solution is not practical for use behind a metal-faced faceplate, such as those typically found in residential kitchens and bathrooms, commercial buildings, etc.

SUMMARY

An illustrative electrical device configured to install within a wall mounted electrical box includes a bezel frame that fits within a faceplate. The bezel frame includes an antenna element.

Another illustrative electrical device includes an antenna bezel frame. The antenna element is mounted within the antenna bezel frame such that at least a portion of the antenna bezel frame is located in front of a plane that contains a front surface of a faceplate when the electrical device is installed.

An illustrative device kit includes a first antenna bezel frame and a first antenna element. The first antenna element is mounted to the first antenna bezel frame such that the first antenna element is located a distance forward of a plane that contains a front surface of a faceplate when the first antenna bezel frame is installed in a field configurable electrical device. At least a portion of the first antenna bezel frame that includes the first antenna element protrudes through an opening in the faceplate.

An illustrative process for controlling a load includes receiving, at a first electrical device, a control signal with an antenna element of the first electrical device. The antenna element is mounted within a bezel frame of the first electrical device such that the antenna element is located a distance forward of a plane that contains a front surface of a faceplate when the first electrical device is installed in a wallbox. Control information is obtained from the control signal using at least a radio frequency circuitry component of the first electrical device, where the radio frequency circuitry component is in electrical communication with the antenna element. A load in electrical communication with the first electrical device is controlled based on the control information.

Other principal features and advantages will become apparent to those skilled in the art upon review of the following drawings, the detailed description, and the appended claims.

BRIEF DESCRIPTION OF THE DRAWINGS

The accompanying figures further illustrate the present invention. The components in the drawings are not necessarily drawn to scale, emphasis instead being placed upon clearly illustrating the principles of the present subject matter. In the drawings, like reference numerals designate corresponding parts throughout the several views.

Prior art

Prior art

Prior art

Figure 1:
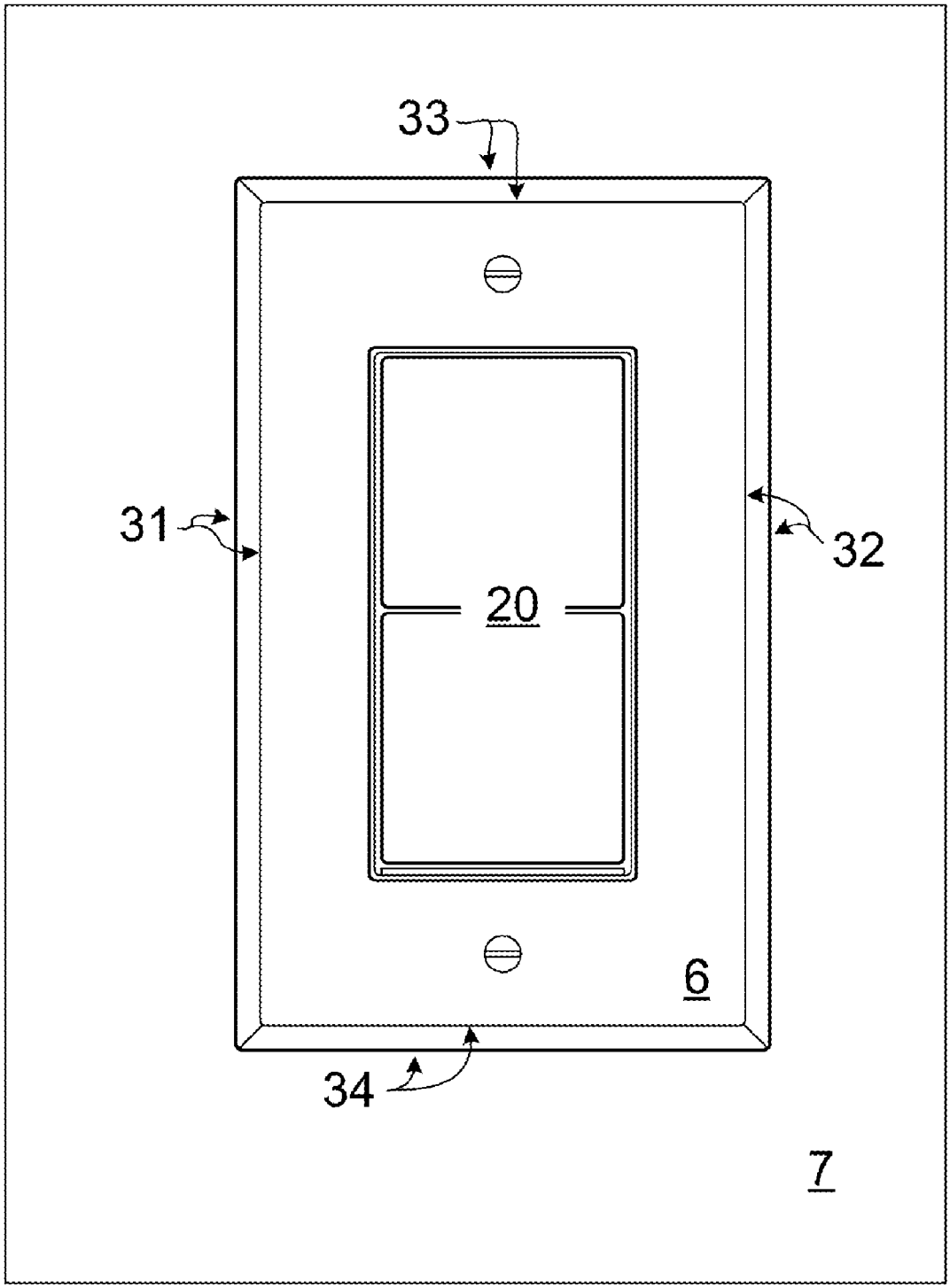
FIG. 1 PRIOR ART
FIG. 1 depicts a traditional wall mounted lighting dimmer as might typically be found in residential construction.
Figure 2:
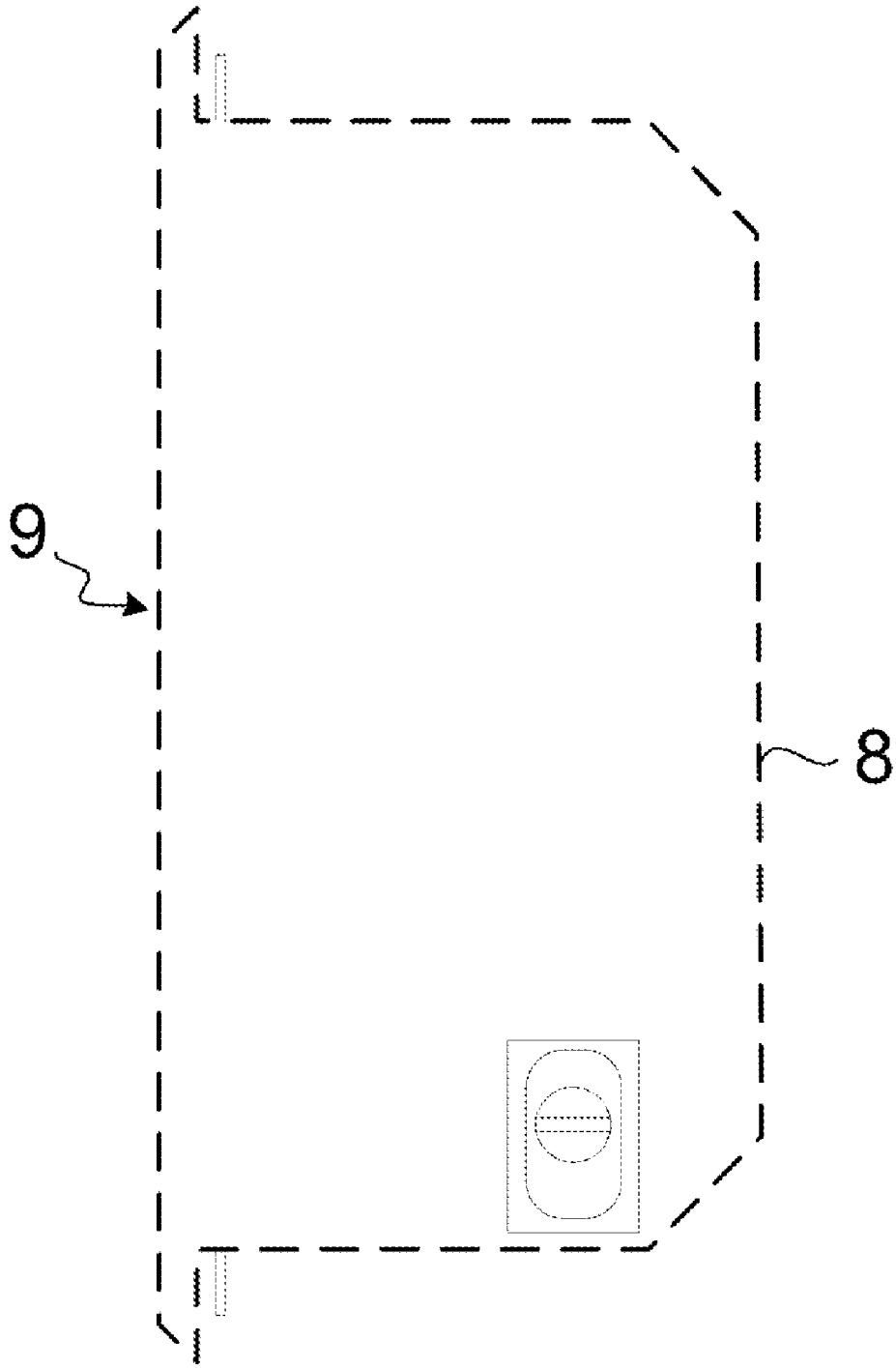
FIG. 2 PRIOR ART
FIG. 2 depicts a three-dimensional region available for mounting a traditional internal antenna of a light dimmer.
Figure 3:
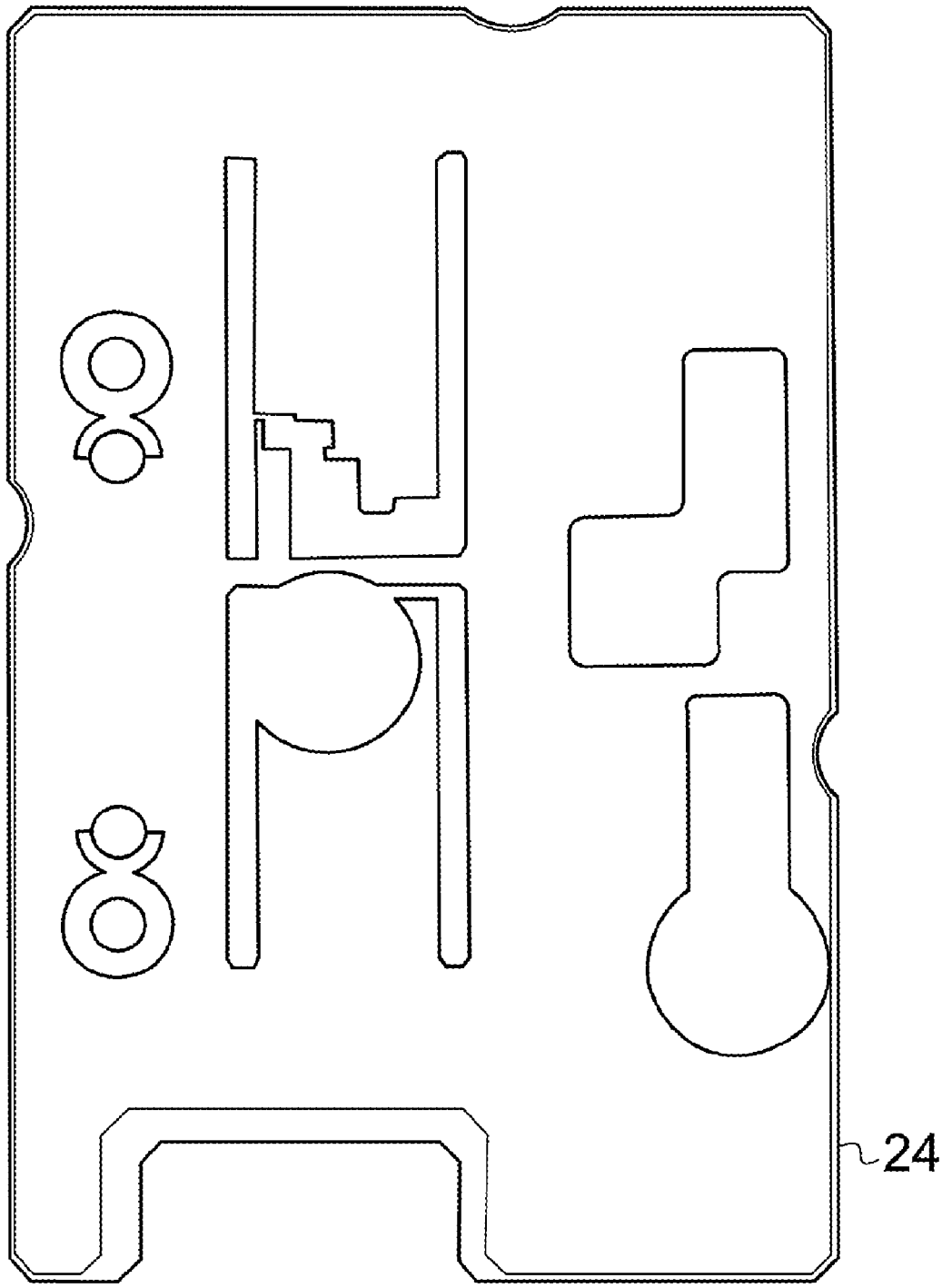
FIG. 3 PRIOR ART
FIG. 3 depicts a typical printed circuit board antenna used in a traditional light dimmer Prior art
Figure 4:
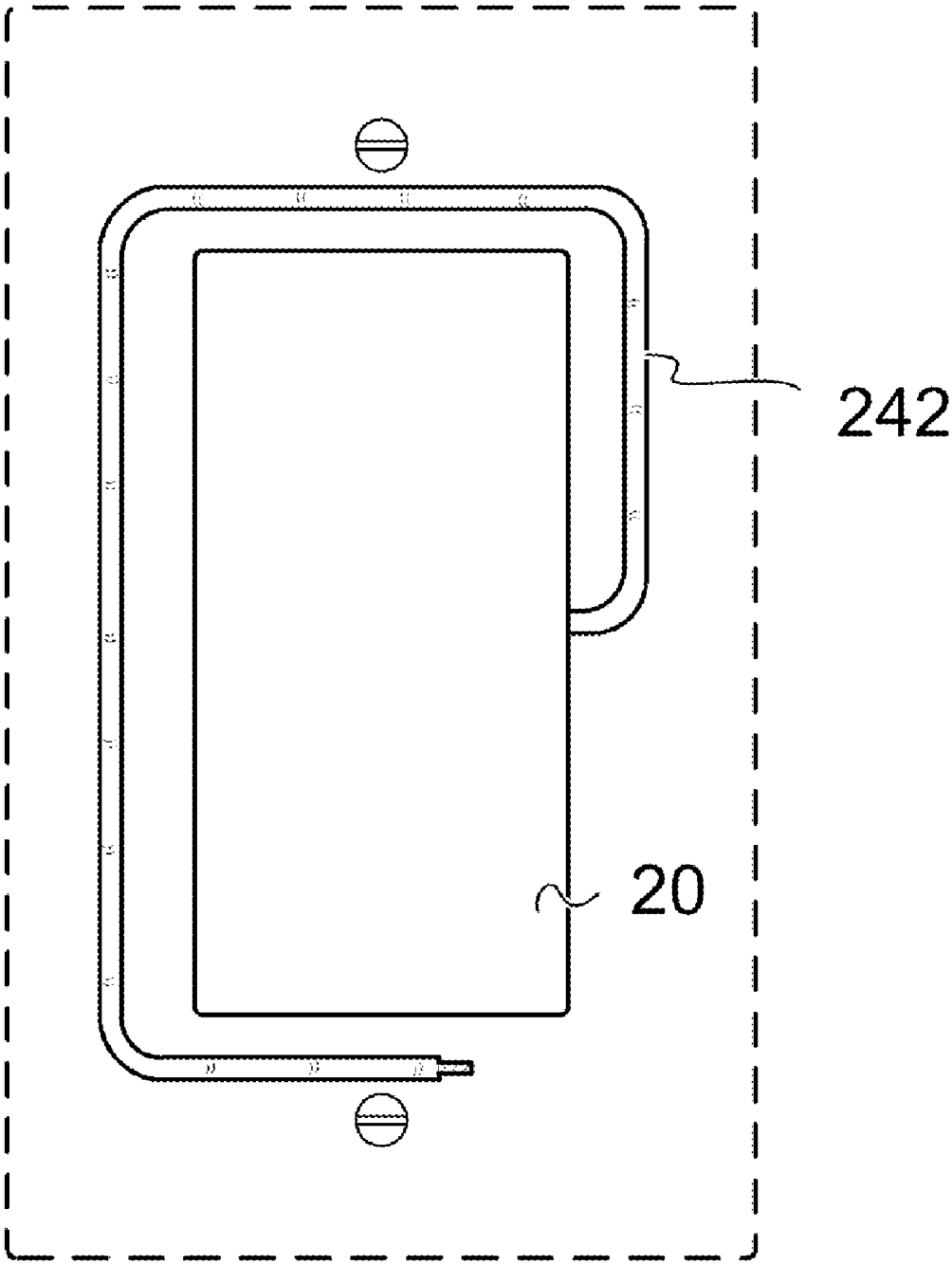
FIG. 4 PRIOR ART
FIG. 4 depicts a light dimmer with an extended wire antenna positioned behind a faceplate.

The following is a list of the major elements in the drawings in numerical order.

3 faceplate
4 wall
5 electrical wallbox
6 faceplate in prior art configuration
7 wall in prior art configuration
8 electrical wallbox in prior art configuration
9 front surface of faceplate in prior art configuration
20 RF-controlled lighting dimmer in prior art configuration
24 printed circuit board antenna in prior art configuration
31 left edges of faceplate in prior art configuration
32 right edges of faceplate in prior art configuration
33 top edges of faceplate in prior art configuration
34 bottom edges of faceplate in prior art configuration
35 front surface of faceplate 3
41 back housing portion
42 support plate
61 rocker switch key capsule assembly
62 two-button key capsule assembly
64 four-button key capsule assembly
71 housing
72 electrical interface assembly
73 housing cover
74 antenna bezel frame
242 extended wire antenna in prior art configuration
618 rocker switch mechanical actuator
721 connector
722 radio frequency circuitry component
725 status indicator
728 push button switch
731 spring-loaded connector
732 spring-loaded connector
735 light pipes
739 fastening screw
741 air gap lever actuator
742 antenna element
942 monopole antenna element
943 loop antenna element

DETAILED DESCRIPTION

Reference will now be made to the illustrative embodiments depicted in the drawings, and specific language will be used herein to describe the same. It will nevertheless be understood that no limitation of the scope of the subject matter described herein is thereby intended. Alterations and further modifications of the embodiments illustrated and described herein, and additional applications of the embodiments illustrated and described herein, which would occur to one skilled in the relevant art and having possession of this disclosure, are to be considered within the scope of the subject matter described herein. Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

In the last several years, wireless infrastructure has developed at a rapid pace. Residential home wireless networks are now common place. Standards like "Bluetooth", "Wi-Fi", "Zigbee", and "Zwave" have been developed and each of these standards allow multiple wireless devices, from various vendors, to coexist. Advantageously, these new wireless standards typically operate in relatively high frequency bands, such as the ISM band centered about 2.440 GHz, that have correspondingly short wavelengths (e.g., ¼ wavelength=1.2 inches). As such, the inventors have perceived that it is possible to design traditional antenna configurations (i.e. monopole, dipole, etc.) within the physical dimensions of a residential single-gang wallbox for a device that operates in the GHz range. At the relatively short ¼ wavelengths ($\lambda$) associated with frequencies such as 2.440 GHz, special antenna configurations such as the those used in the prior art can be avoided.

As described above, the prior art antenna systems for wall-mounted dimmers are located behind a front surface of the faceplate and have a limited ability to transmit/receive due to interference, poor reception, etc. In addition, because of the low, static frequencies used in the prior art, existing devices do not allow for field-modifying of an RF controlled device to operate at a different operating frequency.

Described herein is a field configurable electrical device such as a light dimmer where the antenna element and the radio frequency (RF) circuitry component (or transceiver) can be changed to an alternate operating frequency (i.e. 2.440 GHz, 3.670 GHz, 5.220 GHz, etc.) in the situation where interference is experienced at a particular frequency. The RF circuitry component can be in the form of a miniaturized packaged configuration, such as a monolithic surface mounted integrated circuit, so that design can be standardized among various vendors and more complex circuitry can be used. The antenna element is mounted to a bezel frame to allow for rapid replacement of the antenna element (and bezel frame) if a change in operating frequency is implemented. In an illustrative embodiment, the bezel frame and the antenna element mounted thereto extend outward from a front surface of a faceplate (through an opening in the faceplate) so that the effect of surrounding metal, such as metal faceplates, and other components on antenna performance is minimized. The field configurable electrical device is also configurable in an aesthetically pleasing manner in order to provide for a uniform look with other appliances. In alternative embodiments, the electrical devices described herein may not be field configurable.

Figure 5:
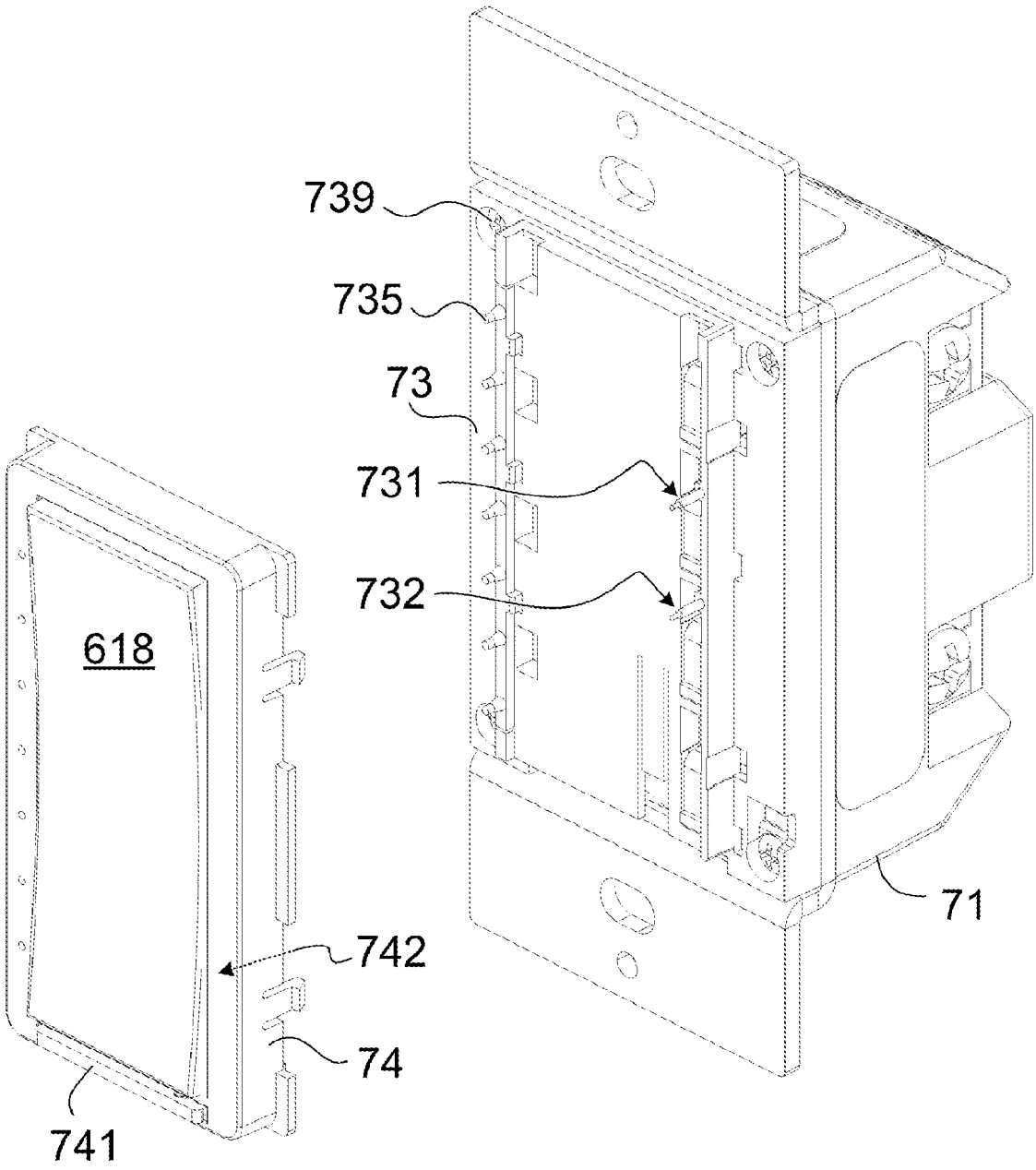
FIG. 5 depicts a field configurable wall-mounted electrical device with an external antenna bezel frame in accordance with an illustrative embodiment.

Refer now to FIG. 5, which depicts components of an illustrative field configurable electrical device. In an illustrative embodiment, the field configurable electrical device can be a local unit that is configured to receive control commands directly from a user or remotely from a remote control (or master) unit. The local unit is in electrical communication with a load (such as a light, fan, window blinds, etc.) to control the load based on the control commands. Alternatively, the field configurable electrical device can be a remote control unit that is remotely located from the local unit and that is used to provide RF signals to control the local unit based on a user command received at the remote control unit. In an illustrative embodiment, the field configurable electrical device is configured as a lighting dimmer having a rocker switch actuator 618 installed within an antenna bezel frame 74. The rocker switch actuator 618 can be used to control the on/off status of the load, a dimmer setting of the load, etc. The antenna bezel frame 74 also incorporates an air gap lever actuator 741 as known to those of skill in the art. In an illustrative embodiment, the antenna bezel frame 74, the rocker switch actuator 618, and/or the air gap lever actuator 741 can be fabricated from plastic, where the particular color of the plastic is selected to aesthetically match an overall installation. Alternatively, other materials may be used.

The antenna bezel frame 74 and the associated color-matched elements are located in front of a housing 71 that contains various electronic components, including control circuitry that is used to control the load based on control commands received through the rocker switch actuator 618 or from a remote control unit. The control circuitry can include and/or be in communication with a microprocessor as known to those of skill in the art. In one embodiment, the control circuitry may include a gated electronic switching device, such as a triac, in order to control voltage going to the load. Alternatively, other types of control circuits known to those of skill in the art may also be used. The housing 71 also houses an RF circuitry component 722 (illustrated in FIG. 10). The RF circuitry component can be a receiver, a transmitter, or a transceiver depending on the embodiment. A housing cover 73 is attached to the front of the housing 71 by screws 739 or other suitable fastening means that may be known to those skilled in the art. Spring-loaded connectors 731 and 732 provide an electrical connection between the RF circuitry component 722 (which is internally mounted within the housing 71) and an antenna element 742 (not visible in FIG. 9) through the housing cover 73. In alternative embodiments, additional or fewer connectors may be used. In another alternative embodiment, the connectors may not be spring-loaded.

Light pipes 735 transmit light from status indicators, such as light-emitting diodes (LED), located within housing 71, for external visibility. The LEDs can indicate the dimmer setting of the load, the on/off status of the load, the speed of the load, etc. In one embodiment, a sensor assembly including a sensor may be mounted within the antenna bezel frame 74. The sensor can be configured to sense one or more environmental parameters such as infra-red, ultrasonic, humidity, temperature, ambient light, etc. In such an embodiment, the LEDs and/or a liquid crystal display (or other type of display) can be used to display the sensor reading(s).

The inventors have discovered that widespread development of digital communication in the gigahertz (GHz) frequency range provides many potential benefits, such as small antenna size, immunity from electrical and triac switching noise, and higher emitted power being allowed by regulatory authorities such as the Federal Communications Commission (FCC). The inventors have also discovered that these benefits can be used in RF-controlled residential devices such as the field configurable electrical device. In one embodiment, the antenna element 742 is a ⅝ wavelength (λ) 'F' type antenna element developed to operate within an ISM frequency band centered around 2.440 GHz. In other embodiments, the antenna element 742 and the RF circuitry component 722 can be designed to operate within other frequency bands, such those centered about 3.670 GHz, 5.220 GHz, etc. Should other gigahertz frequency bands become allocated for the purpose of home automation, the antenna element 742 can be adapted to be compatible with those bands. As discussed in more detail with reference to FIGS. 8 and 9, the inventors have embedded an antenna element into a bezel frame of a prototype lighting dimmer as described herein, and have measured advantageous results.

In an illustrative embodiment, the antenna element 742 is mounted to or within the antenna bezel frame 74 and is connected to the RF circuitry component 722 (shown in FIG. 10) via the spring-loaded connectors 731 and 732. The antenna element 742 can be mounted to or within the antenna bezel frame 74 during or after manufacture by methods such as press-fitting, in-place molding, one or more adhesives, heat-staking, etc. In one embodiment, the antenna element 742 may be fabricated from conductive tape that is configured to adhere to a surface of the antenna bezel frame 74. In an illustrative embodiment, the antenna element 742 is mounted such that the antenna element 742 is not visible when the field configurable electrical device is installed in a wall mounted electrical box. For example, the antenna element 742 can be mounted so that at least a portion of the front surface (or front portion) of the antenna bezel frame 74 covers the antenna element 742 (i.e., the antenna element 742 may be molded into the front surface of the antenna bezel frame 74 such that the antenna element 742 is encapsulated within the antenna bezel frame 74, the antenna element 742 may be mounted to a rear side of the front surface of the antenna bezel frame 74, etc.) Alternatively, the antenna element 742 may be visible to a user through a transparent portion of the antenna bezel frame 74, or the antenna element 742 may be mounted such that at least a portion of the antenna element 742 is on a front side of the front surface of the antenna bezel frame 74.

In contrast to some prior art implementations in which the antenna is located behind one or more key capsules, the antenna element 742 of the field configurable electrical device is located to the side of the key capsules (or buttons), which allows for the use of metallic decorative elements on the key capsules where the use of such decorative elements would not be practical using the antennas taught in the prior art. In one embodiment, the key capsules used with the field configurable electrical device may even be made from a metal, such as aluminum. In prior art systems in which an antenna is mounted behind the key capsule, a metal key capsule would lead to interference and poor reception, and would be impractical. Alternatively, plastic may also be used for the key capsule(s).

Figure 6:
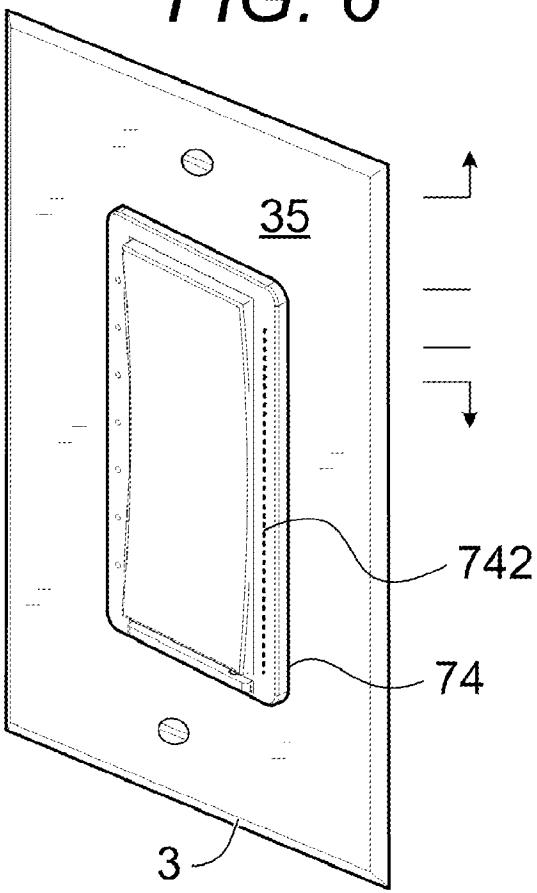
FIG. 6 depicts the antenna element location of the wall mounted electrical device of FIG. 5 in accordance with an illustrative embodiment.

Refer now to FIG. 6 which shows the antenna bezel frame 74 of the field configurable electrical device located in relative position to a faceplate 3 after a typical residential installation. More specifically, FIG. 6 shows the relative location of the antenna element 742 portion (illustrated as a dashed line) of the antenna bezel frame 74 with respect to the forward (or front) surface 35 of the faceplate 3 after installation. In contrast to the prior art, the antenna element 742 is mounted to the antenna bezel frame 74. In an illustrative embodiment, the antenna element 742 is molded into the front surface of the antenna bezel frame 74.

Figure 7:
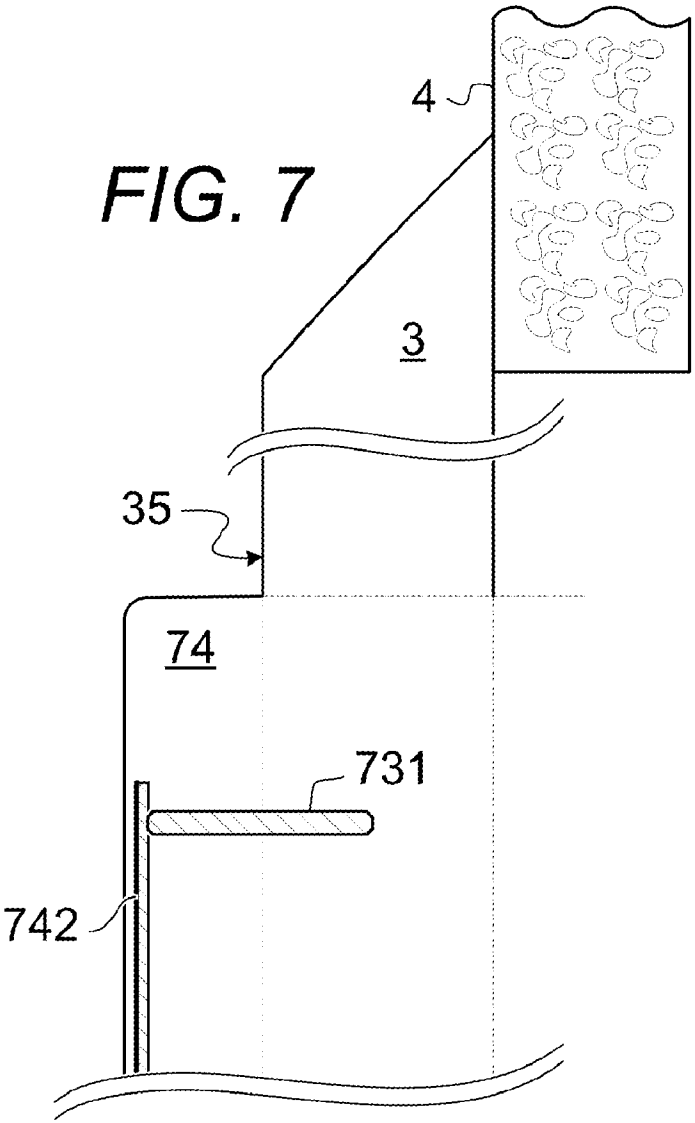
FIG. 7 depicts a magnified partial view of the antenna element location of the wall mounted electrical device of FIG. 5 in accordance with an illustrative embodiment.

FIG. 7 illustrates further details, in a magnified cross-sectional view, regarding an illustrative location of the antenna element 742. As illustrated, a rear edge of the faceplate 3 contacts the wall 4 on which the faceplate 3 is installed. Also shown are details around the area where antenna bezel frame 74 partially protrudes through the faceplate 3. In an illustrative embodiment, the antenna element 742 is located, after installation, at a predetermined distance forward (or in front) of a plane that contains the front surface 35 of the faceplate 3. The predetermined distance can be one or more millimeters, one or more centimeters, etc. As used herein, forward of the front surface of the faceplate can refer to the antenna element 742 being positioned in a direction that extends outward from the plane that contains the front surface of the faceplate (and the wall on which the faceplate is mounted) and into a room or space that is defined by the wall 4.

Figure 8:
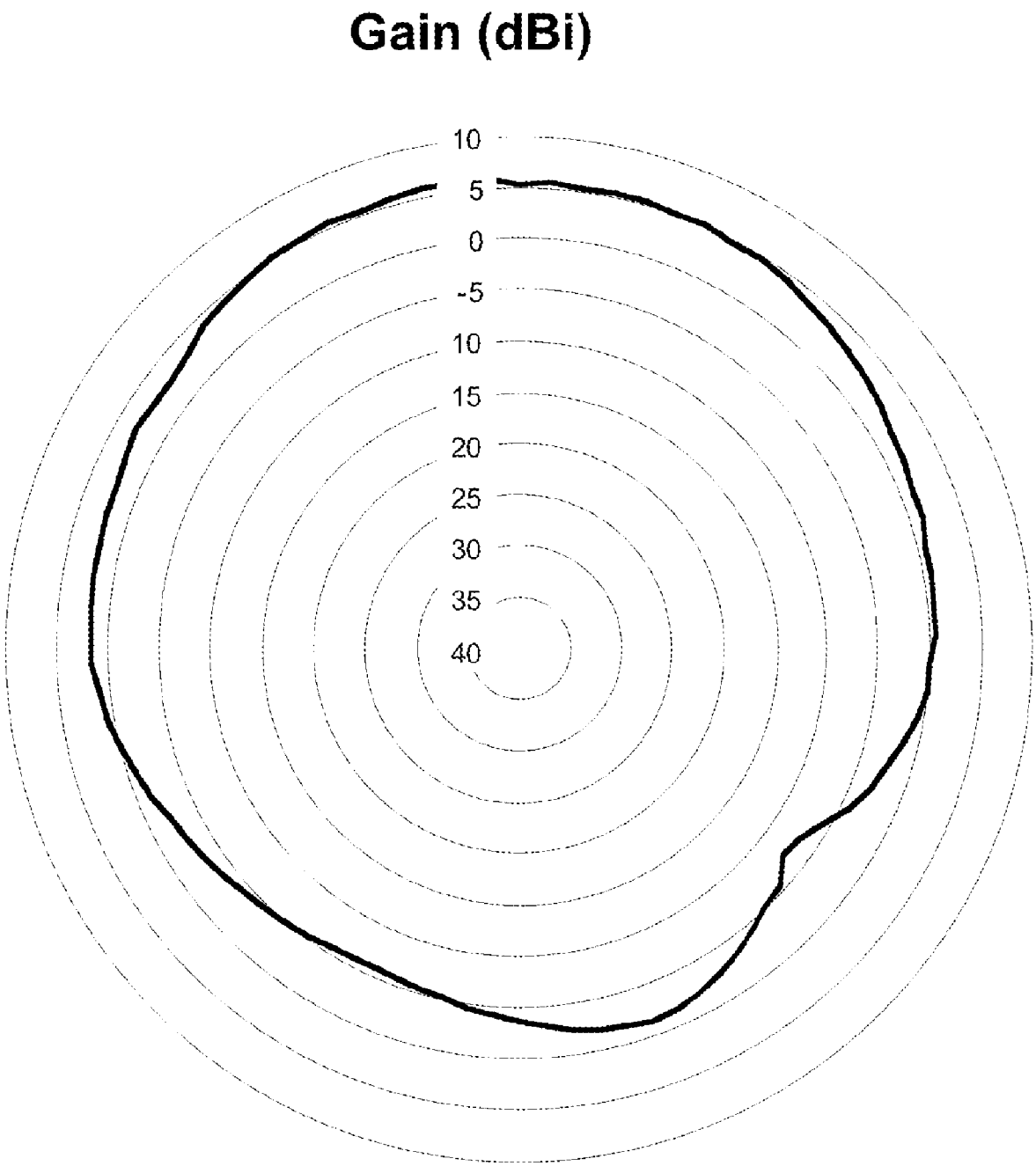
FIG. 8 depicts a measured antenna propagation pattern about a vertical axis in accordance with an illustrative embodiment.
Figure 9:
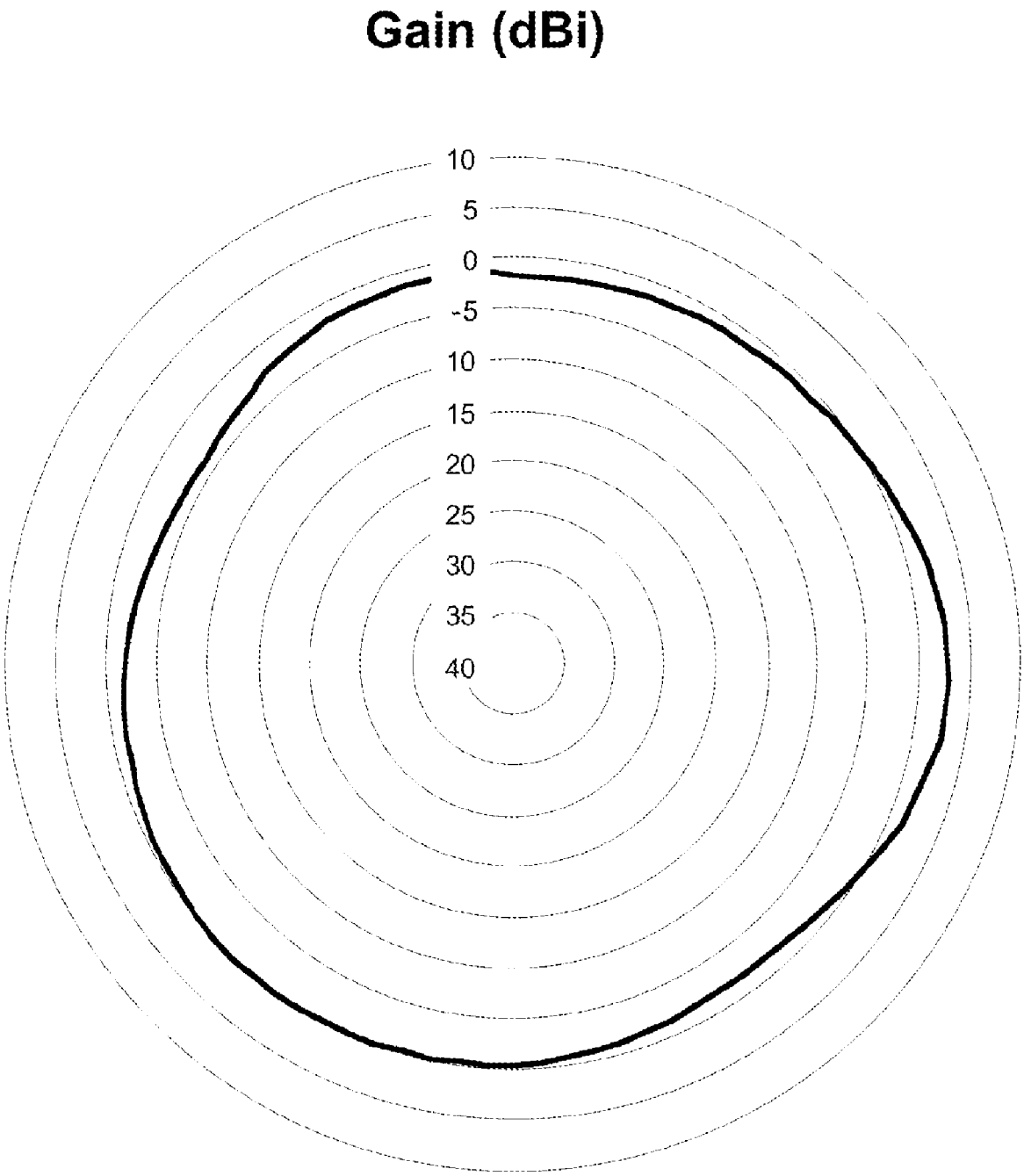
FIG. 9 depicts a measured antenna propagation pattern about a horizontal axis in accordance with an illustrative embodiment.

Refer now to FIG. 8, which depicts antenna propagation measurements that illustrate the performance of a ⅝ wavelength (λ) F type antenna installed in the bezel of a prototype lighting dimmer device. More specifically, FIG. 8 depicts a measured antenna propagation pattern (vertical polarization) about a vertical axis of the antenna element for a particular external antenna bezel frame, and demonstrates the particularly favorable characteristics that are obtained by locating the antenna element forward of the front surface of the faceplate. FIG. 8 illustrates the gain in dBi (decibels referenced against an isotropic radiator), where the maximum gain is 6.02 dBi and the average gain is 0.15 dBi. FIG. 9 depicts a measured antenna propagation pattern (vertical polarization) about a horizontal axis of the antenna for the same particular external antenna bezel frame. FIG. 9 illustrates the gain in dBi, where the maximum gain is 2.82 dBi and the average gain is −0.81 dBi. FIG. 9 also demonstrates that the same favorable characteristics are obtained by locating the antenna element forward of the front surface of the faceplate.

The measured results illustrated in FIGS. 8 and 9 translate into approximately a 50% theoretical improvement in RF range as compared to any of the embodiments known in the prior art. Those skilled in the art will recognize that the ⅝ wavelength (λ) F type antenna used in the prototype has approximately a 2 decibel (dB) gain advantage over a monopole antenna in a similar configuration.

In an illustrative embodiment in which the field configurable electrical device is a local unit, the antenna element 742 can be used to communicate with a remote device such as a remote control (i.e., master) field configurable electrical device or a separate local field configurable electrical device. For example, a remote control field configurable electrical device can be used to control the lighting within a house, room, or building. The remote control field configurable electrical device can communicate with the local field configurable electrical device via the antenna element 742. The remote control field configurable electrical device can, in response to a user command, transmit a control signal to the antenna element 742 such that a user can remotely control the load (i.e., turn the load on/off, adjust the speed of the load, adjust a dimmer setting of the load, etc.). The control signal is received by the antenna element and provided to the radio frequency circuitry component 722 through the spring-loaded connectors 731 and 732. Control information can be obtained from the control signal using the RF circuitry component 722 and/or other components such as a microprocessor, etc. by any method known to those of skill in the art. Control circuitry can be used to control the load based on the control information. Status information can also be transmitted by the antenna element 742 of the local field configurable electrical device to an antenna element of the remote control field configurable electrical device to provide the remote control field configurable electrical device with a status of the local field configurable electrical device. For example, the local field configurable electrical device may transmit information regarding a most recent command received at the local field configurable electrical device (regardless of whether the command originated at the local unit or the remote control unit). The remote control unit can receive the status information and update a display (such as one or more LEDs, a liquid crystal display, etc.) that presents the status of the local unit.

In an illustrative embodiment, the field configurable electrical devices described herein can be configured to be nodes of a mesh network. A wireless network based on the IEEE 802.11b/g standard typically has each node in the network communicate with a central source, which is typically part of a wired network. In contrast, each node in a mesh network can communicate with other nodes in the network. In one embodiment, every node in the mesh network can communicate with every other node. In another embodiment, nodes can communicate with other intermediary nodes in the mesh network that are not within radio frequency range. As such, devices which are remotely located from one another (i.e., out of range) may be able to communicate to one another through other devices in the mesh network.

Figure 10:
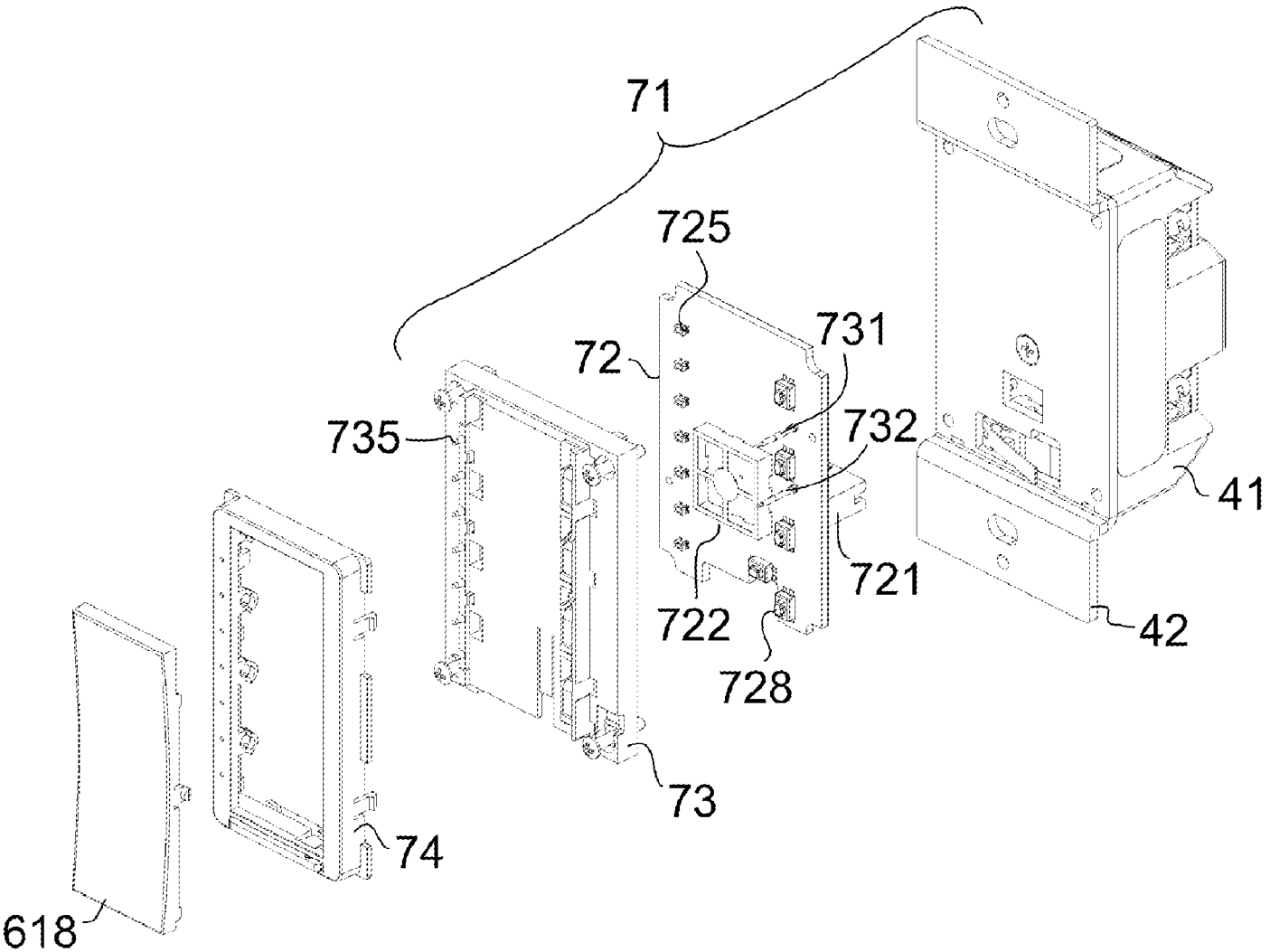
FIG. 10 is an exploded view of a field configurable wall-mounted electrical device in accordance with an illustrative embodiment.

FIG. 10 is an exploded view of a field configurable wall-mounted electrical device incorporating an external antenna bezel frame in accordance with an illustrative embodiment. A mechanical actuator, such as the rocker switch actuator 618, is installed within the antenna bezel frame 74, which can be color matched. The antenna bezel frame 74 is located in front of the housing 71.

The housing 71 further comprises the housing cover 73, an electrical interface assembly 72, a support plate 42, and a back housing portion 41. The support plate 42, which can be formed from a material having a high thermal and electrical conductivity, such as aluminum, can be used to dissipate heat from the triac or other control circuitry components. The support plate 42 can also act to provide RF shielding between the antenna element and other electronics components mounted within the housing 72.

The electrical interface assembly 72 includes the RF circuitry component 722, status indicators 725 (such as LEDs), pushbutton switches 728, and a connector 721 to connect with the remainder of the electrical components that are mounted in the back housing portion 41. Advantageously, adding the connector 721 to the electrical assembly 72 allows for easy change-out or replacement of the RF circuitry component 722. The housing cover 73 includes light pipes 735 to transmit light from the status indicators on the electrical interface assembly 72 to a user of the device through the antenna bezel frame 74. The housing 71 may further house a power supply circuit (and/or regulator) as known to those of skill in the art. The power supply circuit can be wired in parallel with a controlled load and that is directly connected to electrical neutral. Alternatively, the power supply circuit may be wired in series with the controlled load and may be connected to electrical neutral only through the controlled load. Alternatively, any other wiring configuration known to those of skill in the art may be used.

The housing 71 may further house a computer-readable medium, such as a tangible memory, that is configured to store computer-readable instructions. The computer-readable instructions can be executed by a microprocessor and/or other components of the field configurable electrical device. Upon execution, the computer-readable instructions can cause the field configurable electrical device to perform any of the operations described herein, such as controlling the load, extracting control information from a control signal, generating status information to be transmitted, etc.

Figure 11:
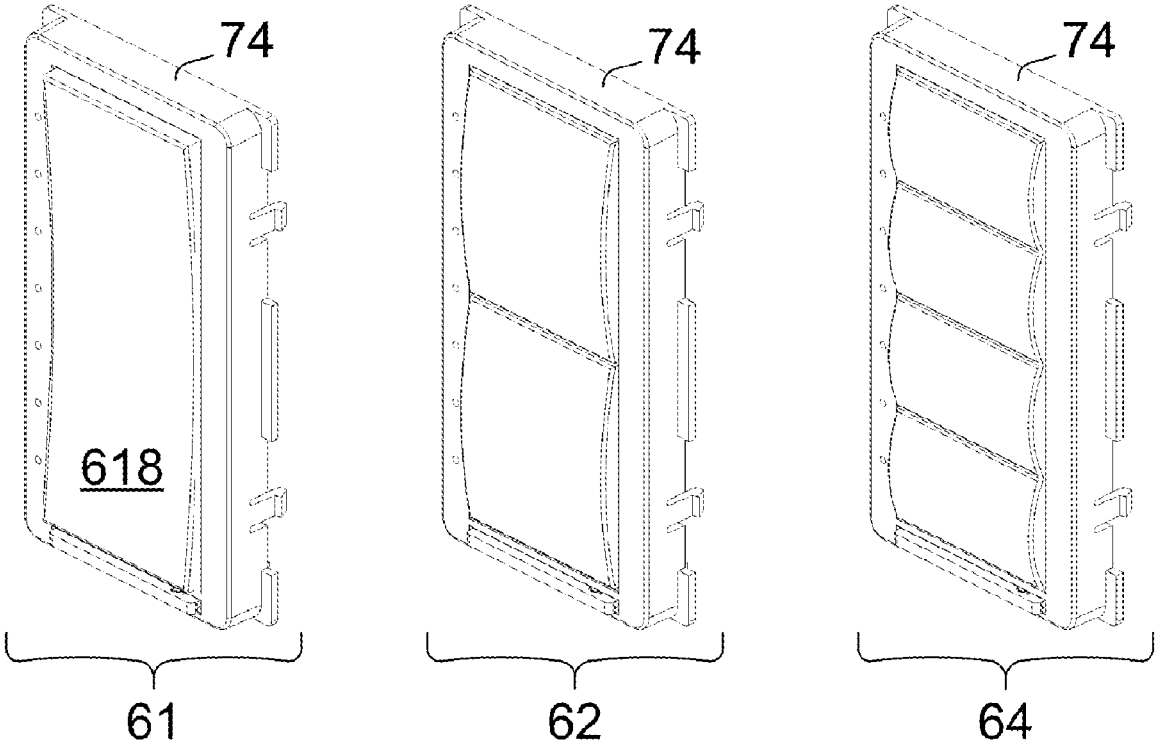
FIG. 11 depicts key capsule assemblies that may be installed on a wall-mounted electrical device in accordance with an illustrative embodiment.

FIG. 11 depicts various key capsule assemblies that may be installed within a wall-mounted electrical device in accordance with an illustrative embodiment. In alternative embodiments, different key capsule (or button) configurations may be used. In order to perform simple up-down light dimming functions, an embodiment of the field configurable electrical device can incorporate the rocker switch actuator 618 (as part of a rocker switch key capsule assembly 61) and/or a two-button mechanical actuator as part of a two-button key capsule assembly 62. In order to perform multiple functions, such as light dimming and window shade control, a further embodiment of the field configurable electrical device can incorporate a four-button mechanical actuator as part of a four-button key capsule assembly 64. As described herein, the wall-mounted electrical devices can be configured in the field, such as by an installation technician, in order to accommodate many site-specific requirements. Field configuration can include installation of an appropriate key capsule configuration based on the type of load, the available settings for the load, etc. Advantageously, such field configurability allows an installation technician to adapt the electrical device to changing field requirements (or design specifications).

In one embodiment, the field configurable electrical device can be provided as a kit that includes at least two bezel frames, where each of the bezel frames has a mounted antenna element that operates at a different operating frequency. The kit can also include at least two radio frequency circuitry components that correspond to the at least two operating frequencies of the antenna elements. As such, in the event of noise or signal interference, a user can replace the first bezel frame (and antenna element) and the first RF circuitry component operating at a first frequency with the second bezel frame (and antenna element) and the second RF circuitry component operating at a second frequency. Additional sets of bezel frames and RF circuitry components may also be included in the kit. As an example, RF interference may result from the use of the field configurable electrical device with a first bezel frame (including a first antenna element) and a first RF circuitry component that operate at a first frequency of 2.440 GHz. To eliminate the RF interference, the first bezel frame (and the first antenna element) and the first RF circuitry component can be replaced with a second bezel frame (including a second antenna element) and a second RF circuitry component which operate at a second frequency of 3.670 GHz. In one embodiment, the kit can also include a plurality of key capsule configurations.

Figure 12:
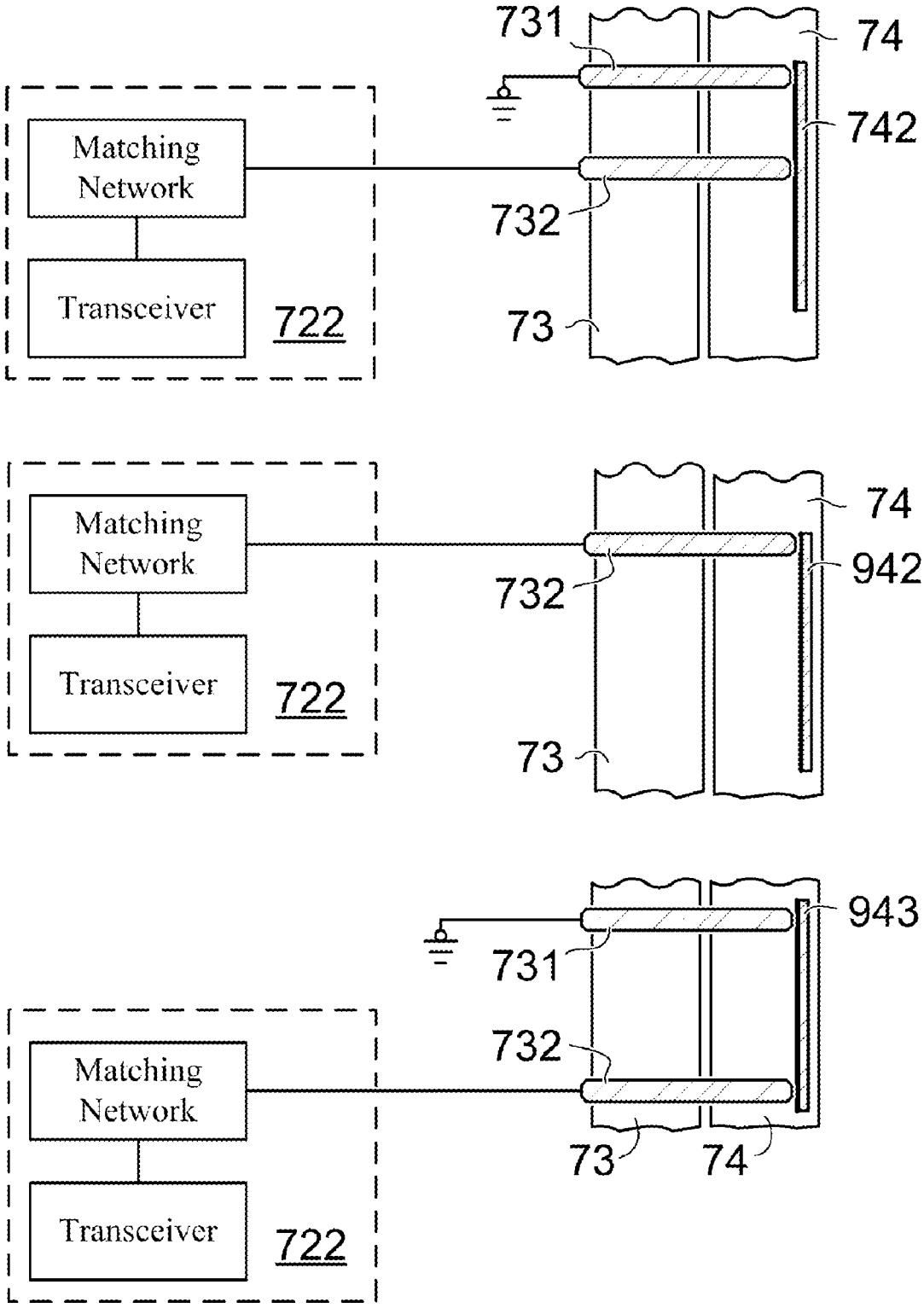
FIG. 12 depicts various antenna configurations that may be used with a wall-mounted electrical device in accordance with an illustrative embodiment.

FIG. 12 depicts various antenna configurations used in illustrative embodiments of the field configurable electrical device. A vertically oriented F type antenna element 742 installed within the antenna bezel frame 74 is used in an illustrative embodiment, although other antenna configurations are also contemplated by the inventors. For example, two alternate embodiments use a monopole antenna element 942 and a loop antenna element 943, respectively. Advantageously, each of these alternate antenna element configurations uses the same spring-loaded connectors 731 and 732 that extend through the housing cover 73. However, the exact positioning of the spring-loaded connectors 731 and 732 are dependent on the specific antenna element and the operating frequency. In alternative embodiments, different antenna configurations may also be used.

Although dimmers have specifically been mentioned, additional embodiments can include other devices mounted in an electrical wallbox, such as keypads.

The embodiments described herein solve the aforementioned problems in the prior art and have wide ranging industrial applicability. The field configurable electrical devices are modular to help prevent and avoid RF interference. The field configurable electrical device also utilize an antenna element configuration that results in improved reception and transmission. The antenna element configuration, along with the frequency ranges used, also contribute to devices that are aesthetically pleasing.

The following is a list of the acronyms/abbreviations/symbols used in the specification in alphabetical order.

AC alternating current
dB decibel
FCC Federal Communications Commission
GHz gigahertz
ISM instrument, scientific, and medical (RF band)
LAN local area network
LED light emitting diode(s)
MHz megahertz
NEMA National Electrical Manufacturers Association
PCB printed circuit board
RF radio frequency
VAC volts, alternating current
λ wavelength The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An electrical device, comprising:

(a) a bezel frame configured to fit within a faceplate, wherein the bezel frame includes an antenna element;

(b) a radio frequency circuitry component in electrical communication with the antenna element and configured to receive a control signal from the antenna element;

(c) a housing having a housing cover, wherein the housing cover is located between the antenna element and the radio frequency circuitry component; and (d) one or more connectors configured to place the antenna element and the radio frequency circuitry component in electrical communication, wherein the one or more connectors protrude through the housing cover.

2. The electrical device of claim 1, wherein the one or more connectors comprise spring loaded connectors.

3. The electrical device of claim 1, further comprising a power supply located in the housing, wherein the power supply is wired in series with a controlled load, and wherein the power supply is connected to electrical neutral through the controlled load.

4. The electrical device of claim 1, wherein the antenna element and the radio frequency circuitry component operate at a frequency, and wherein the frequency is in the gigahertz range.

5. The electrical device of claim 1, wherein the antenna element is mounted to the antenna bezel frame via press-fitting, in-place molding, one or more adhesives, or heat-staking.

6. The electrical device of claim 1, wherein the antenna element is fabricated from conductive tape.

7. The electrical device of claim 1, wherein the antenna element is molded into a front surface of the bezel frame.

8. A device kit, comprising:

(a) a first antenna bezel frame; and (b) a first antenna element mounted to the first antenna bezel frame such that the first antenna element is located a distance forward of a plane that contains a front surface of a faceplate when the first antenna bezel frame is installed in a field configurable electrical device; and wherein at least a portion of the first antenna bezel frame that includes the first antenna element is configured to protrude through an opening in the faceplate.

9. The device kit of claim 8, further comprising:

(a) a first radio frequency circuitry component corresponding to the first antenna element, wherein the first antenna element and the first radio frequency circuitry component operate at a first frequency;

(b) a second antenna bezel frame, at least a portion of which is configured to protrude through an opening in the faceplate, and a second antenna element mounted to the second antenna bezel frame such the second antenna element is located at least the distance forward of the plane that contains the front surface of the faceplate when the second antenna bezel frame is installed in the field configurable electrical device; and (c) a second radio frequency circuitry component corresponding to the second antenna element, wherein the second antenna element and the second radio frequency circuitry component operate at a second frequency.

10. The device kit of claim 9, wherein the first antenna element and the second antenna element are fabricated from conductive tape.

11. The device kit of claim 9, wherein the first antenna element is molded into a front surface of the first antenna bezel frame.

12. The device kit of claim 9, further comprising:

(a) a housing having a housing cover, wherein the housing cover is located between the first antenna element and the first radio frequency circuitry component when the first antenna element and the first radio frequency circuitry component are installed in the field configurable electrical device; and (b) one or more connectors configured to place the first antenna element and the first radio frequency circuitry component in electrical communication when the first antenna element and the first radio frequency circuitry component are installed in the field configurable electrical device, wherein the one or more connectors protrude through the housing cover.

13. The device kit of claim 12, wherein the one or more connectors comprise spring-loaded connectors.

14. The device kit of claim 9, wherein the first antenna element comprises one of an F type antenna element, a monopole antenna element, or a loop antenna element.

15. The device kit of claim of claim 9, wherein the first frequency is different than the second frequency, and wherein the first frequency and the second frequency comprise one of 2.440 gigahertz (GHz), 3.670 GHz, or 5.220 GHz.

16. An electrical device, comprising:

(a) a bezel frame configured to fit within a faceplate, wherein the bezel frame includes an antenna element;

(b) a radio frequency circuitry component in electrical communication with the antenna element and configured to receive a control signal from the antenna element;

(c) a housing having a housing cover, wherein the housing cover is located between the antenna element and the radio frequency circuitry component; and (d) one or more connectors configured to place the antenna element and the radio frequency circuitry component in electrical communication;

(e) wherein the one or more connectors protrude through the housing cover; and (f) wherein the one or more connectors comprise spring loaded connectors.

17. The electrical device of claim 16, further comprising a power supply located in the housing, wherein the power supply is wired in series with a controlled load, and wherein the power supply is connected to electrical neutral through the controlled load.

18. The electrical device of claim 16, wherein the antenna element and the radio frequency circuitry component operate at a frequency, and wherein the frequency is in the gigahertz range.

19. The electrical device of claim 16, wherein the antenna element is mounted to the antenna bezel frame via press-fitting, in-place molding, one or more adhesives, or heat-staking.

20. The electrical device of claim 16, wherein the antenna element is fabricated from conductive tape.

* * * * *